US006276361B1

(12) United States Patent
White

(10) Patent No.: US 6,276,361 B1
(45) Date of Patent: Aug. 21, 2001

(54) DIVER PROTECTIVE GUARD

(76) Inventor: Sharon F. White, 4311 Fern Creek Dr., Jacksonville, FL (US) 32277

( * ) Notice: Subject to any disclaimer, the term of this patent is extended or adjusted under 35 U.S.C. 154(b) by 0 days.

(21) Appl. No.: 09/411,765

(22) Filed: Oct. 4, 1999

(51) Int. Cl.[7] ..... A61M 15/00
(52) U.S. Cl. ..... 128/200.24; 128/201.27
(58) Field of Search ..... 128/200.24, 200.29, 128/201.11, 201.14, 201.27, 201.28, 201.22, 202.18, 202.19, 205.21, 205.22, 202.14; 405/186, 187; 220/724; 114/315

(56) References Cited

U.S. PATENT DOCUMENTS

| | | | | |
|---|---|---|---|---|
| 1,552,979 | | 9/1925 | Billings . | |
| 2,985,552 | | 5/1961 | Watanabe . | |
| 3,578,051 | | 5/1971 | Hammon . | |
| 3,589,971 | | 6/1971 | Reed . | |
| 3,958,716 | | 5/1976 | Korte . | |
| 4,103,806 | | 8/1978 | White . | |
| 4,967,923 | * | 11/1990 | Wren | 220/724 |
| 4,996,982 | * | 3/1991 | Williamson | 128/206.27 |
| 5,160,065 | | 11/1992 | Libes et al. . | |
| 5,253,760 | | 10/1993 | Miller . | |
| 5,429,152 | * | 7/1995 | Van Straaten et al. | 220/724 |
| 5,809,998 | * | 9/1998 | Hughes et al. | 128/204.17 |

* cited by examiner

*Primary Examiner*—John G. Weiss
*Assistant Examiner*—Teena Mitchell
(74) *Attorney, Agent, or Firm*—Thomas C. Saitta

(57) ABSTRACT

A protective pad device mounted onto the regulator valve assembly of a scuba tank to protect the diver's head from injury or annoyance from contacting the valve assembly with the back of the diver's head, the pad having a flexible, compressible main body with shock absorbing properties.

18 Claims, 3 Drawing Sheets

DIVER PROTECTIVE GUARD

BACKGROUND OF THE INVENTION

The invention relates generally to the field of devices comprising a means to protect the back of a diver's head from injurious or undesirable contact with the regulator valve assembly of a scuba tank. More particularly, the invention relates to such devices which are attachable to the regulator valve assembly, preferably in a removable manner, and are composed of material having shock absorbing properties.

Underwater divers utilize scuba tanks, relatively large canisters of compressed, breathable gas mixtures, to allow for extended and deep excursions in the water such that the user may remain submerged for long periods of time. The term scuba is an acronym for the phrase self-contained underwater breathing apparatus. The tanks are typically elongated metal cylinders with a somewhat semi-spherical upper end having an opening to which is attached a regulator valve assembly. The regulator valve assembly typically comprises a rigid stem member, usually made of metal, which extends axially from the tank several inches and a rigid manifold or connecting conduit to which a flexible hose or hoses are attached, the hoses extending to the mouthpiece worn by the diver, pressure gauges or other devices. The manifold or connecting conduit, also usually made of metal, are sometimes mounted forward of the stem member, i.e., in the direction toward the diver when the tanks are being used. The tanks are worn strapped to the back of the diver, with the regulator valve assembly positioned just behind the neck of the diver. Because of this positioning, it is relatively easy for the diver to strike the back of his or her head against the rigid regulator valve assembly. Additionally, the harness maintaining the tank on the diver may loosen as the diver goes deeper since the pressure increase causes the diver's chest to contract. When the diver is swimming in the water and strikes the assembly while tilting his or her head to look upward, this contact is annoying and uncomfortable. In other circumstances, however, the accidental contact can be hazardous, such as when jumping into the water from a dive boat. If the diver is not careful and the angle of entry of the head into the surface of the water is not proper, the water can drive the diver's head forcefully backward against the regulator valve assembly, resulting in damage to the head in the nature of bruising or a laceration, or in extreme circumstances in loss of consciousness. Likewise, if the diver does not properly tuck his or her chin upon entry, the surface of the water can force the tank itself upward to strike the back of the head.

There are devices known for protecting the stems, manifolds or the entire regulator valve assemblies from damage when the scuba tanks are being stored or transported. Examples of such devices are shown in U.S. Pat. No. 4,103,806 to White and U.S. Pat. No. 5,253,760 to Miller. There are also many devices known for the protection of the valve assemblies for any type of compressed gas storage tank. The protective devices are formed of rigid, strong materials, typically metal or hard plastic, because their purpose is to prevent damage to the valve assembly if the tank is dropped or struck by a heavy object. Such devices obviously offer no protection to the diver in the situation when a scuba tank is in use, as a rigid and hard protective device would cause the same problems for the exposed and unprotected back of the diver's head as the naked regulator valve assembly itself. This is seen clearly in the White '806 patent, where the valve guard is designed such that it may be maintained in position on the upper end of the tank while the tank is in use, suitable apertures being provided for access and passage of the flexible hose or hoses, but the device is to be made of high impact plastic or like material. Diving with the guard of White '086 in place would make it more likely that the diver would injure themselves, since the guard presents a larger contact area than the naked regulator valve assembly itself.

It is an object of this invention to provide a protective device in the nature of a shock absorbing pad or body which protects the back of the head of a diver from injurious, painful or annoying accidental contact when attached to the regulator valve assembly of a scuba tank to cover at least the forward, upper portion of the regulator valve assembly. It is a further object to provide such a device which is detachable and adjustable, such that a single device can be used with regulator valve assemblies of differing design yet still be properly disposed between the regulator valve assembly and the back of the diver's head. It is a further object to provide such a device which comprises a flexible, shock absorbing main body with attachment straps for encircling the regulator valve assembly, or portions thereof, such that the main body remains properly positioned during use. These objects, and other objects not specifically expressed but which will become clear after a complete reading of the disclosure, are accomplished as discussed below.

SUMMARY OF THE INVENTION

The invention is in general a protective pad device which is removably attachable to the regulator valve assembly extending from the upper end of a scuba tank, such that the protective pad remains disposed between the regulator valve assembly and the back of the diver's head when the tank is worn. The protective pad is formed primarily of a flexible, compressible, shock absorbing material, such as a polymer foam, so that injury, pain or discomfort from accidental contact between the regulator valve assembly and the back of the diver's head is precluded or reduced.

The protective device comprises a main body composed of the flexible, compressible, shock absorbing material plus attachment means to secure the main body to the regulator valve assembly. The main body is configured of a shape suitable to provide a sufficiently broad barrier over all the components of the regulator valve assembly, and preferably has length and width dimensions much greater than its depth or thickness. The main body may be relatively planar prior to attachment, such that it is flexed to cover the regulator valve assembly, or may be formed with a recessed or cupped interior to receive components of the valve assembly. The attachment means preferably comprises one or more straps with hook-and-loop type closures for easy attachment and removal from the tank, with the length of the straps being sufficient to allow for adjustment to different valve assembly configurations, but alternative attachment means could also be utilized.

DETAILED DESCRIPTION OF THE INVENTION

With reference to the drawings, the invention will now be described in detail with regard for the best mode and the preferred embodiment. In general, the invention is a device which protects the back of a diver's head from accidental contact with the regulator valve assembly attached to the upper end of the scuba tank worn on the divers' back. Such contact may occur from movement of the diver's head when swimming or looking toward the surface, or more drastically from improper water entry technique, where contact with the water surface snaps the diver's head backward or drives the tank upward when jumping from a boat or platform. At a minimum, contact with the regulator valve assembly is annoying, but impacts of greater force can result in pain or serious injury.

Figure 1:
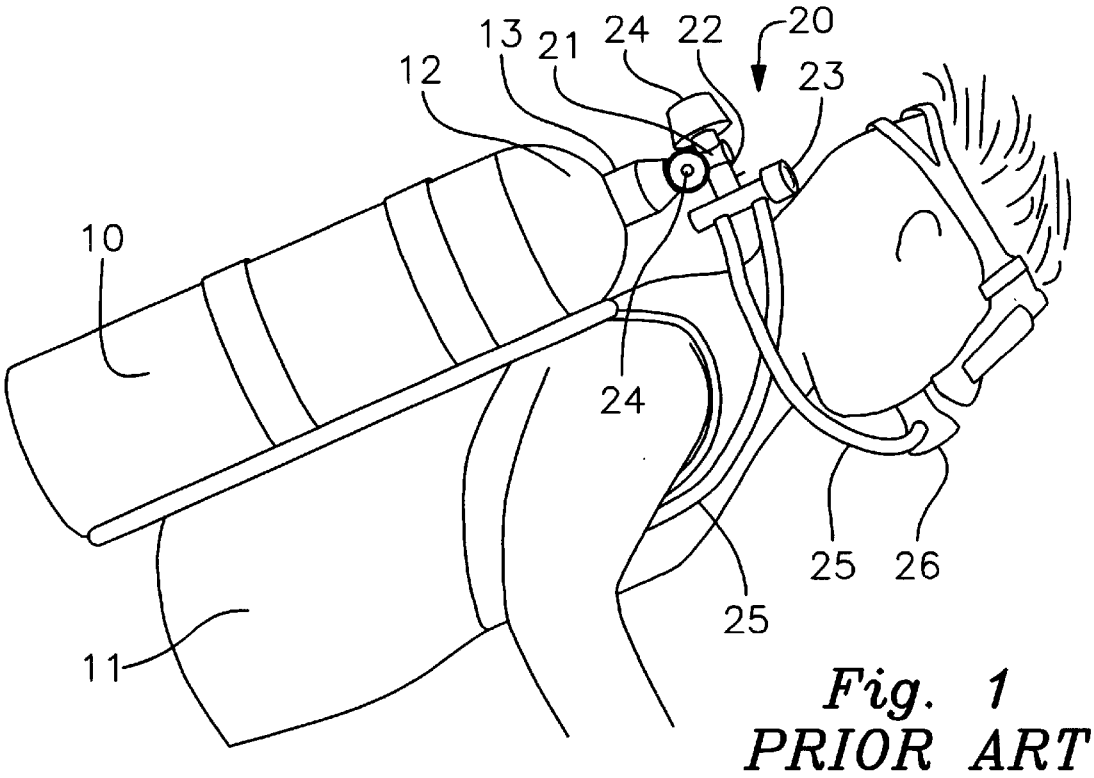
Fig. 1 PRIOR ART
FIG. 1 is a prior art view of a diver wearing a scuba tank where the regulator valve assembly behind the diver's head is exposed.
Figure 2:
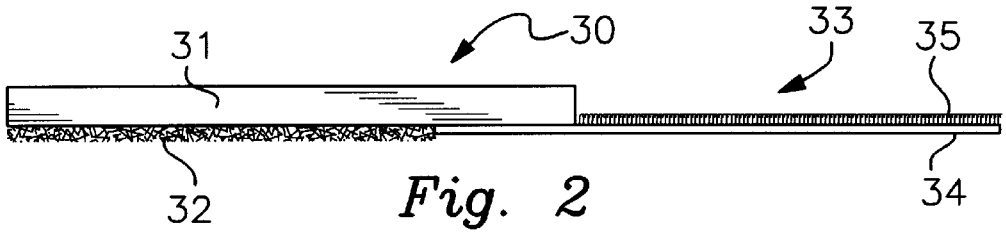
FIG. 2 is a side view of the protective pad device.
Figure 3:
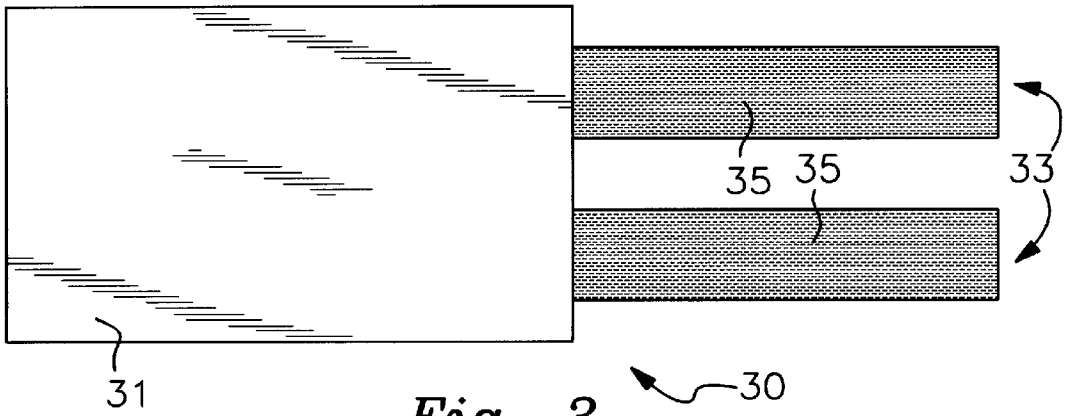
FIG. 3 is a front view of the protective pad device.

FIG. 1 illustrates a diver 99 wearing a typical scuba tank 10 containing compressed breathable gases which enables the diver 99 to remain underwater for long periods of time. The tank 10 is secured by a harness 11 to the torso of the diver 99. The upper end 12 of the tank 10 has an opening with a valve fitting 13 to receive a regulator valve assembly 20. This gear is well known in the diving art, and the invention is not restricted to any particular tank 10 or regulator valve assembly 20 construction. As shown in the figure, when the tank 10 is positioned on the diver's back, the upper end 12 and the regulator valve assembly 20 is disposed immediately behind the neck and the back of the head of the diver 99, with only a few inches separating the diver's head from the hard regulator valve assembly 20. Any rapid rearward movement of the diver's head will result in undesirable contact with the regulator valve assembly 20. Regulator valve assemblies 20 may have various designs, and a typical structure is illustrated in the drawings. As shown herein for illustrative purposes, the regulator valve assembly 20 comprises a stem member 21 which extends from the tank valve fitting 13 and a manifold member 23, connected by a post member 22 generally perpendicular to the stem member 21. The manifold member 23 provides one or more openings and connectors for the attachment of flexible hoses 25, at least one of which is connected to a mouthpiece 26 for delivering breathable gas to the diver 99. Valve knobs 24 control the passage of the gas through the regulator valve assembly 20.

In the most basic embodiment, the invention is a protective pad device 30 comprising a main body 31 and attachment means 33 for removably connecting the main body to the regulator valve assembly 20 of the tank 10, such that the main body 30 is disposed forward of the valve assembly 20, that is between the valve assembly 20 and the back of the diver's head when the tank 10 is being worn. In particular the pad 30 is positioned so that the main body 31 covers the upper portion of the valve assembly 20. The main body 31 is composed of any material suitable for exposure to fresh and salt water which is compressible and flexible, such that material has shock absorbing properties. Expanded polymer foams or rubbers such as neoprene are highly suitable. The material should be sufficiently dense to spread and absorb impact forces, yet not so dense that flexibility and compression are precluded. As shown in FIGS. 2 through 5, the main body 31 may have a generally rectangular shape, where the length and width dimensions are significantly greater than the thickness dimension. Many other shapes are also suitable, such as circular, elliptical, hourglass, etc. Typical illustrative dimensions for the main body 31 are approximately six inches in length, approximately 3.5 inches in width and approximately 0.5 inches in thickness, but actual dimensions can be changed with the protective pad 30 still operating as desired.

Figure 4:
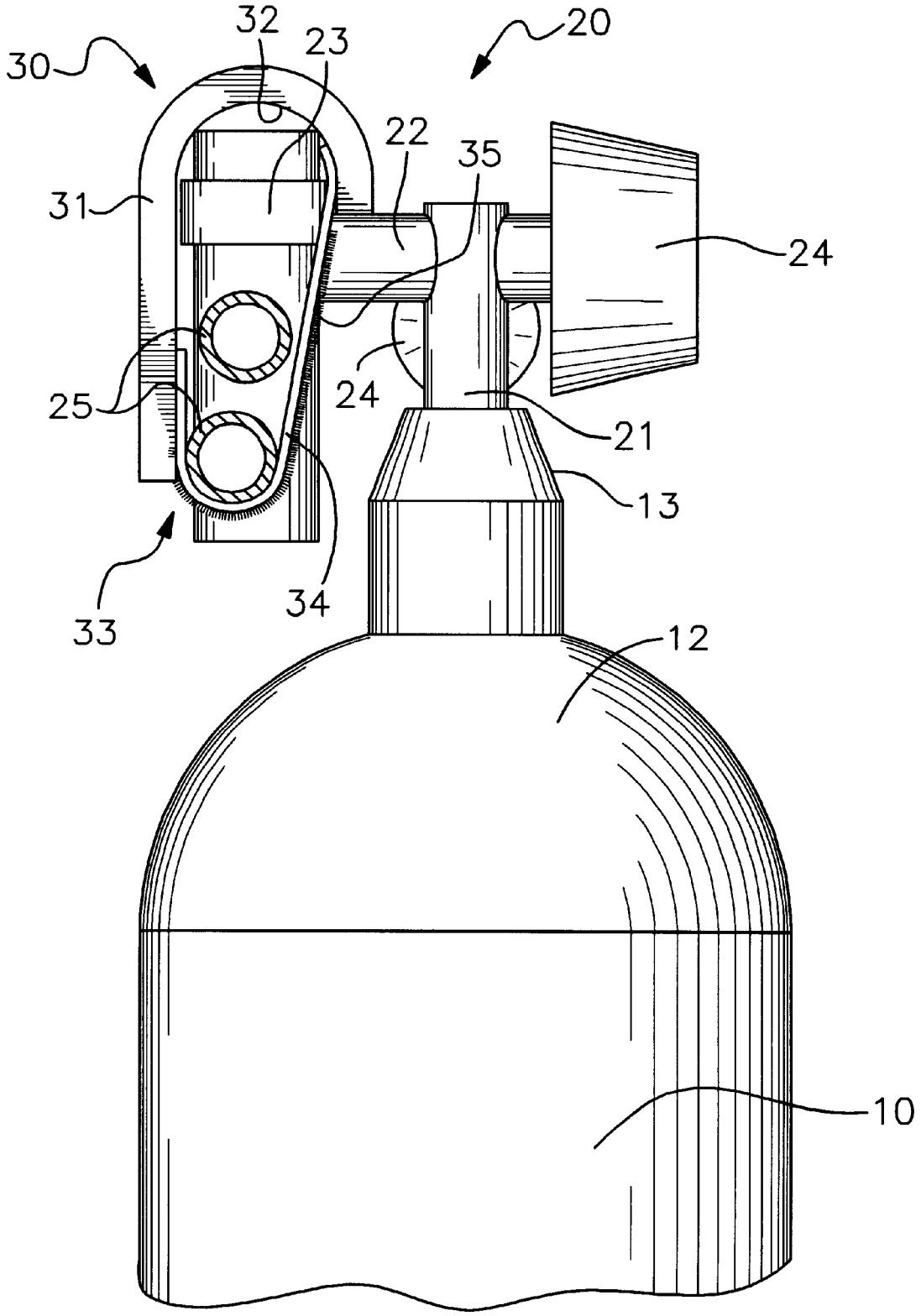
FIG. 4 is a side view of the protective pad device as attached onto the regulator valve assembly of a scuba tank.
Figure 6:
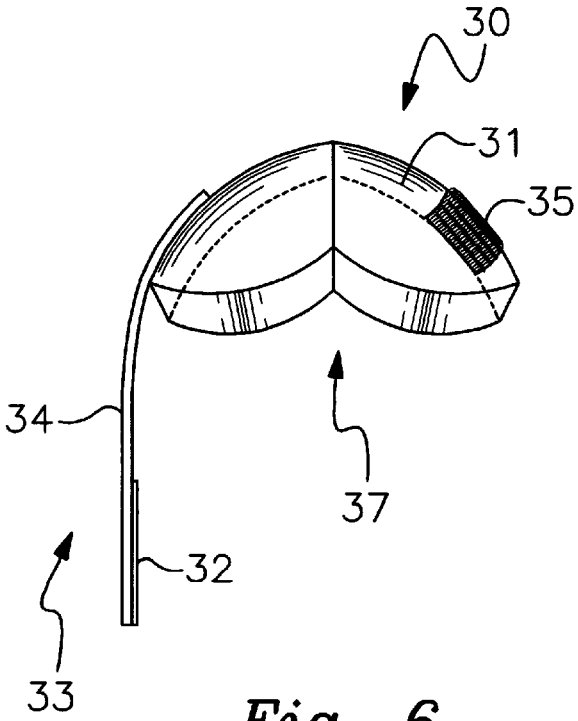
FIG. 6 is a side view of still another alternative embodiment of the protective pad device, where the main body has a cupped configuration to receive components of the regulator valve assembly.

The attachment means 33 may be any suitable mechanism for securing the main body 31 in proper position on the valve assembly 20, but preferably the attachment means 33 allows the pad 30 to be removed after installation. A most suitable construction for the attachment means 33 comprises the use of hook-and-loop or hook-and-pile fasteners, which consist of one or more elongated straps members 34 having a hooked surface 35, the straps 34 being attached to the main body 31, either permanently or temporarily, such that each strap member 34 extends a sufficient distance, approximately five to six inches, to encircle components of the valve assembly 20 on the scuba tank 10 and then be temporarily joined to a napped surface 32 on one side of the main body 31, as shown in FIG. 4. Alternatively, the napped surface 32 may be disposed on the strap members 34 with the hooked surface disposed on the main body 31, as shown in FIG. 6.

Preferably the attachment means 33 comprises a pair of strap members 34 mounted generally parallel to each other with a small space between them. With this design, the straps 34 can be disposed one on each side of the post member 22 and stem member 21, with the hoses 25 passing out to either side and thus enclosed between the straps 34 and the main body 31. This configuration prevents the main body 31 from excessive movement in all directions, so that the main body 31 remains properly disposed relative to the valve assembly 20 during use. Further as shown, the flexibility of the main body 31 allows it to be bent over and around the upper end of the valve assembly 20, as shown in FIG. 4. Because of the hook-and-pile type fastening mechanism, as opposed to the use of a buckle, snap rivet, elastic members or other type of fastener, the distance between each end of the main body 31 is adjustable, which in combination with the flexible nature of the main body 31 allows the protective pad 30 to be securely joined onto various designs of valve assemblies. This adjustability is maximized where both ends of strap members 34 may be repositioned on the back of the main body 31, thus allowing the straps 34 to extend from the main body 31 at different angles if desired.

Figure 5:
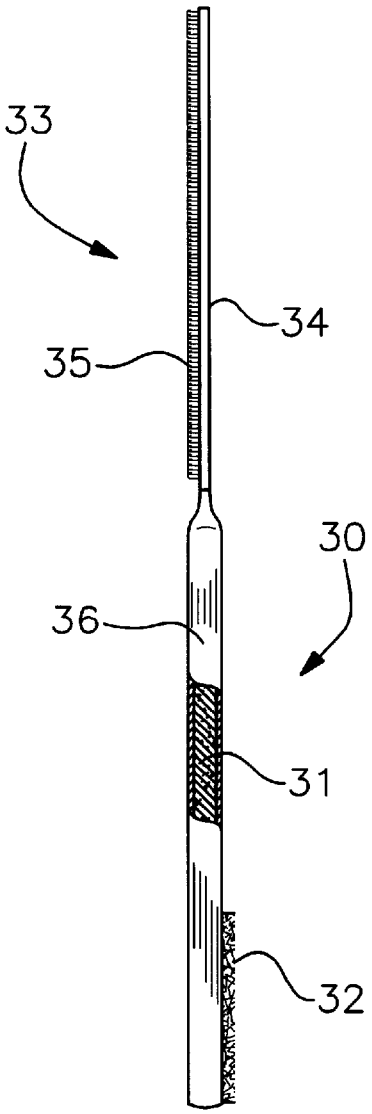
FIG. 5 is a side view, partially shown in cross-section, of an alternative embodiment of the protective pad device, where the main body comprises a flexible, compressible pad member encased within a more durable or decorative cover.

The main body 31 may be encased within a cover member 36, as shown in FIG. 5, with the strap members 34 having the hooked surface 35 permanently affixed to the cover 36 and the napped surface 32 attached to the cover 36, or alternatively with the hooked surface 35 and napped surface 32 reversed. This allows a more durable material to be used as the cover 36, or provides a way to customize the protective pad 30 with decorative designs, patterns or elements.

In an alternative embodiment, the main body 31 may be configured or pre-formed to provide a recess 37, such that the components of the valve assembly 20 will be received within the recess 37 when the main body 31 is secured to the valve assembly 20. As shown in FIG. 6, the main body 31 may be given a cupped or curved configuration, such that less or minimal flexing is required for the main body 31 to properly encircle or receive the valve assembly 20. Alternative configurations which provide for a recess 37, such as hemispheres, boxes, etc., are also contemplated as suitable.

It is to be understood that certain equivalents and substitutions for components set forth above may be obvious to those skilled in the art, and therefore the true scope and definition of the invention is to be as set forth in the following claims.

I claim:

1. A protective device for attachment to the regulator valve assembly of a scuba tank to protect the user of the tank from injurious or undesirable contact between the regulator valve assembly and the back of the diver's head, the protective device comprising a main body composed of a flexible, compressible, shock-absorbing material and attachment means to attach said main body to a regulator valve assembly such that the main body is disposed between such a regulator valve assembly and the back of a diver's head when such a tank is in use, said attachment means comprising at least one flexible strap member connected to said main body and adapted to encircle in combination with said main body such a regulator valve assembly.

2. The device of claim 1, where said main body is comprised of a polymer foam material.

3. The device of claim 1, where said attachment means is composed of a hook and loop type fastener material.

4. The device of claim 3, where said hook and loop type fastener material comprises a hook surface and a loop surface, where one of said hook surface or said loop surface is attached to said main body and the other of said hook surface or said loop surface is attached to said at least one flexible strap member.

5. The device of claim 4, where said at least one flexible strap member is completely removable from said main body.

6. The device of claim 1, where said main body is generally rectangular.

7. The device of claim 1, where said main body is generally cup-shaped.

8. The device of claim 1, where said attachment means are repositionable relative to said main body such that the relative angle between said main body and said at least one flexible strap member can be varied as required to adapt to different configurations of regulator valve assemblies.

9. The device of claim 1, where said attachment means comprise a pair of flexible strap members adapted to encircle in combination with said main body such a regulator valve assembly.

10. A protective device in combination with the regulator valve assembly of a scuba tank to protect the user of the tank from injurious or undesirable contact between the regulator valve assembly and the back of the diver's head, the protective device comprising a main body composed of a flexible, compressible, shock-absorbing material and attachment means to attach said main body to the regulator valve assembly such that the main body is disposed between the regulator valve assembly and the back of a diver's head, said attachment means comprising at least one flexible strap member connected to said main body and adapted to encircle in combination with said main body said regulator valve assembly.

11. The device of claim 10, where said main body is comprised of a polymer foam material.

12. The device of claim 10, where said attachment means is composed of a hook and loop type fastener material.

13. The device of claim 12, where said hook and loop type fastener material comprises a hook surface and a loop surface, where one of said hook surface or said loop surface is attached to said main body and the other of said hook surface or said loop surface is attached to said at least one flexible strap member.

14. The device of claim 13, where said at least one flexible strap member is completely removable from said main body.

15. The device of claim 10, where said main body is generally rectangular.

16. The device of claim 10, where said main body is generally cup-shaped.

17. The device of claim 10, where said attachment means are repositionable relative to said main body such that the relative angle between said main body and said at least one flexible strap member can be varied as required to adapt to different configurations of regulator valve assemblies.

18. The device of claim 10, where said attachment means comprise a pair of flexible strap members adapted to encircle in combination with said main body said regulator valve assembly.

* * * * *